United States Patent [19]

McCue

[11] Patent Number: 4,899,407

[45] Date of Patent: Feb. 13, 1990

[54] WATERBED SHEET FASTENERS

[76] Inventor: Brian McCue, 11 Lafleur Street - Apt 102, LaSalle, Canada, H8R 3G4

[21] Appl. No.: 337,466

[22] Filed: Apr. 13, 1989

[51] Int. Cl.[4] ..... A47C 21/02

[52] U.S. Cl. ..... 5/508; 5/498; 24/72.5

[58] Field of Search ..... 5/508, 498, 496, 451, 5/452; 24/72.5

[56] References Cited

U.S. PATENT DOCUMENTS

| | | | |
|---|---|---|---|
| 2,930,053 | 3/1960 | Nowels . | |
| 3,092,848 | 6/1963 | Gronvold . | |
| 4,040,133 | 8/1977 | Gilreath | 24/72.5 |
| 4,486,909 | 12/1984 | McKneelen | 5/451 |
| 4,521,970 | 6/1985 | Jester | 5/498 |
| 4,782,543 | 11/1988 | Hutton et al. | 5/498 |

FOREIGN PATENT DOCUMENTS 43248 5/1912 Canada .

481762 3/1952 Canada .

*Primary Examiner*—Alexander Grosz

*Attorney, Agent, or Firm*—Lespérance & Associés

[57] ABSTRACT

A sheet securing assembly for use in releasably maintaining in extended condition over the mattress of a rectangular bed the bedsheet and mattress cover of that bed. The securing assembly comprises four straps, each mounted to one corresponding corner of the mattress. Each strap includes an elongated body. A first hook and loop fastener is positioned under the mattress to releasably anchor the strap to box mattress. A second hook and loop fastener releasably anchors the strap to the bedsheet. A third hook and loop fastener releasably anchors the strap to the mattress cover. Each strap is characterized in that they are easily released from above the bed, enabling effortless disengagement of the hook and loop fasteners without having to lift the mattress spacedly above the box mattress. The present invention is particularly effective for waterbeds.

7 Claims, 2 Drawing Sheets

WATERBED SHEET FASTENERS

FIELD OF THE INVENTION

This invention relates to means for preventing a bedsheet and mattress cover sheet of a bed from being released from the peripheral edges of the mattress.

BACKGROUND OF THE INVENTION

In a bed, the mattress cover and the bedsheet are usually edgewisely (releasably) secured to the mattress by their engagement under the peripheral underface of the mattress, wherein the weight of the mattress will bias the sheets in their extended position. It is desirable that the two sheets should continue to be fully extended during the whole night instead of entangling in a bulge, for a variety of reasons including proper thermal insulation, comfort and preventing wear of the mattress proper.

However, due to non-voluntary movements of the sleeping person in his bed associated with dream activity, the sheets may become accidentally dislodged from the underface of the mattress. This problem is more acute with waterbeds, in that the waterbag has a flexible wall wherein the securing action of the edgewise biasing force thereof against the edge section of the sheets is reduced.

A search of prior art has unveiled the following: Canadian patent #143,248 dated October 1912; Canadian patent #481,762 issued March 1952; U.S. Pat. Nos. 2,930,053 issued March 1960; and 3,092,848 issued June 1963. These patents show various strap means for securing the sheets of a bed about the mattress. The Canadian patent 481,762 in the name of Block, Sher and Block, is particularly interesting in that it discloses strap means 16, 22 positioned under the mattress of a bed for releasably securing a bedsheet 30 and a mattress cover 10. A general problem of these sheet securing means is that they usually require for their disengagement that the mattress be lifted from the box mattress. This problem is compounded in the case of waterbeds, wherein the weight of the body of water contained in the waterbag, which may be several tens of kilograms, may discourage use of such bedsheets securing means.

Moreover, waterbeds require special bedsheets having corner pockets, which special bedsheets can easily cost more than twice the price of conventional bedsheets.

OBJECTS OF THE INVENTION

An important object of the invention is to provide means to prevent the bedsheet and mattress cover from disengaging from the peripheral edge section of the mattress, characterized in that these means are easily releasable.

Another important object of the invention is to specifically address the needs of waterbed owners, in providing means to releasably secure the bedsheet and mattress cover to a waterbed, being designed for use in effortless engagement/disengagement of these sheet securing means.

An object of the invention is that the above-noted sheet securing means be of low manufacturing cost.

An object of the invention is to provide such sheet securing means, which would enable a waterbed owner to use conventional, low-cost bedsheets for his waterbed.

A further object of the invention is that the above-noted sheet securing means be easily adaptable to any type of beds including waterbeds, conventional spring mattress beds, for the blankets of a baby's crib, and also for portable sleeping bags in association with a closed-flooring tent.

SUMMARY OF THE INVENTION

In accordance with the objects of the invention, there is disclosed a sheet securing assembly for use in releasably maintaining in extended condition over the quadrangular mattress of a bed the quadrangular bedsheet and quadrangular mattress cover of that bed, said mattress being supported by a support frame member, said securing assembly comprising four strap members each mounted to one corresponding corner of said quadrangular bed mattress; wherein each strap member includes an elongated body, first fastening means positioned under said mattress to releasably anchor said strap body to said support frame member, second fastening means to releasably anchor said strap body to said bedsheet, and third fastening means to releasably anchor said strap body to said mattress cover; each said strap member further including release means, enabling effortless disengagement of said fastening means without having to lift said mattress spacedly above said support frame member.

Preferably, said bed mattress is an elastomeric waterbed envelope, said envelope enclosing water and being installed within a large quadrangular recess of a rigid waterbed supporting frame constituting said support frame member, whereby said water bag shapingly conforms to said recess.

Advantageously, said support frame defines within said recess a bottom wall and four side walls and further including an insulating liner, applied directly against said bottom and side walls of said support frame, said first fastening means being anchored to said insulating liner.

In accordance with two distinct embodiments of the invention, said second fastening means and/or third fastening means are preferably positioned below said mattress; or, alternately, said second or third fastening means are positioned above said mattress.

Profitably, each strap member elongated body is made of a single rigid strap.

It is envisioned that said rigid strap be made from an extensible material.

Preferably, each one of said fastening means includes a pair of separate fastening bands chosen from the group comprising hook-and-loop fasteners and mushroom-and-velours fasteners.

In a third embodiment of the invention, there is disclosed a waterbed comprising a large, flexible bag, enclosing a body of water; a water bed support frame, defining a large recess being quadrangular in plan view and into which is engaged said water bag whereby the latter shapingly conforms to said recess; a flexible insulating liner, applied freely against the inner walls of said support frame within said recess; a quadrangular mattress cover, applied against the top surface of said bag; a quadrangular bedsheet, applied against the top surface of said mattress cover and defining a transverse flap or pocket at each corner thereof for engagement about a corner portion of said water bag; four straps one at each corner of said bag, each strap having first fastening means at one end thereof and second fastening means at the other end thereof for releasably securing said strap to said mattress cover proximate the corresponding corner thereof at a position above said waterbag, and third fastening means for releasably securing said strap to said bedsheet pocket at a position under said waterbag; each said strap further including release means, enabling effortless disengagement of said fastening means without having to lift said mattress spacedly above said support frame member.

In this latter embodiment of the invention, each of said fastening means preferably includes a pair of separate fastener bands chosen from the group consisting of hook-and-loop fasteners and mushroom-and-velours fasteners.

DETAILED DESCRIPTION OF THE INVENTION

Figure 2:
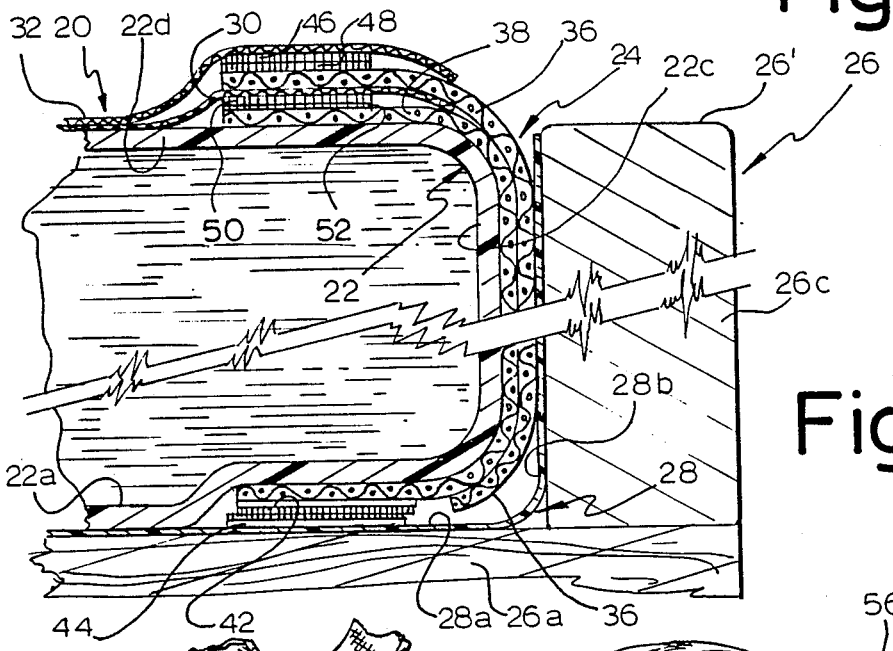
FIG. 2 is a sectional view of the elements of FIG. 1.

Waterbed 20 conventionally consists of a large elastomeric envelope 22 enclosing and retaining a body of water W. Envelope 22 is flexible and therefore of highly variable shape. Generally, this envelope 22 is engaged into the recess 24 of a large bed frame box 26, said recess being rectangular in horizontal sectional view, wherein the envelope is biased into a shape conforming to and occupying the volume of aid recess 24. This frame 26, which may be constructed from wood, is usually spaced from ground (not shown), and defines a base wall **25*a* and four side walls (only two adjacent walls 26b, 26c being shown in FIG. 2) upwardly projecting edgewisely from the four edge sections of the base wall 26a. A plastic or vinyl sheet or liner 28*a*, is applied against the surface of the inner walls of box frame 26, in freely standing fashion, to prevent direct contact of the wood with the water envelope, which contact could damage the wood. When inside recess 24, envelope 22 therefore defines a bottom horizontal wall section 22*a*, resting against the wooden base wall 26*a* spacedly by plastic liner section 28*a* parallel thereto, four vertical side wall sections (only tow, 22*b*, 22*c* being shown) again spacedly by liner sections (only one, 28*b*, being shown) and a top, horizontal, free wall 22*d* in substantial register with the to edge 26' of the wooden side walls 26*b*, 26*c***.

A mattress cover sheet 30 is usually added against the envelope side wall sections **22*b*, 22*c*, the top wall section 22*d* (see FIG. 6) and it could preferably also further extend about the peripheral edge sections of the bottom wall 22*a* of the envelope (FIG. 2) wherein it is retained in position by the biasing weight of the water in the waterbed thereabove. A (lower) bedsheet 32 is then added over the mattress cover, and an additional upper bedsheet (not shown) over the lower bedsheet 32**, to follow its contour except for one edge section thereof: i.e., the "mouth" (not shown) defined by the upper and lower bedsheets and through which the sleepy person will engage for placing his body between the bedsheet and the mattress cover sheet. All this is of course well known.

Figure 1:
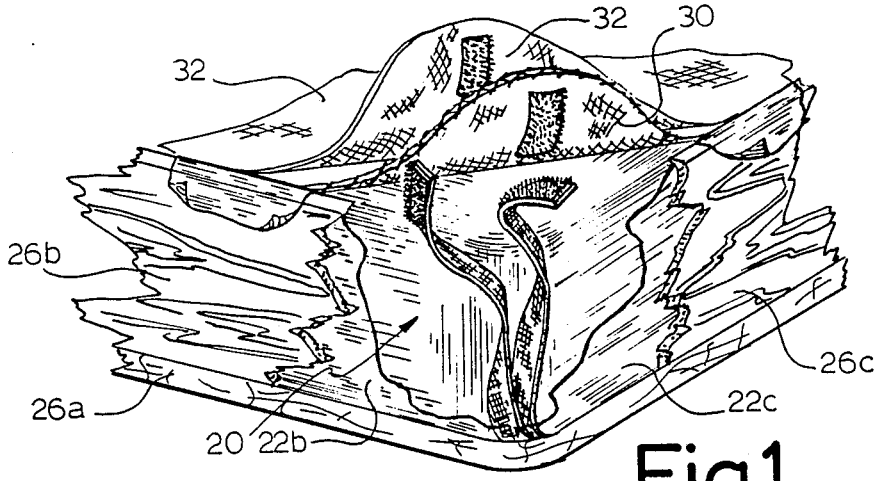
FIG. 1 is a partially broken, perspective view of a corner of waterbed box frame and waterbed proper, showing a first embodiment of sheet fastening strap means in accordance with the teachings of the invention.
Figure 3:
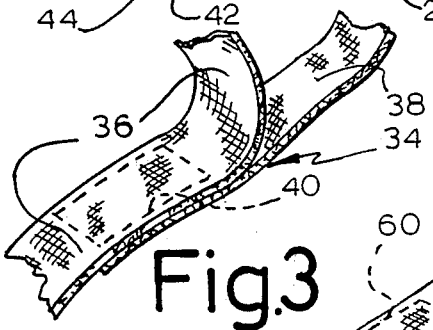
FIG. 3 is an enlarged perspective view of a section of said first embodiment of strap means.

Now, in accordance with the teachings of the invention, there is provided securing means for releasably securing the bed sheet 32 and mattress cover 30 to the peripheral edge sections of the waterbed envelope 22. In the first embodiment of securing means shown as 34 in FIGS. 1–3, there is provided at each of the four corners of the waterbed, two rigid straps 36, 38 interconnected at an intermediate section thereof at sewing zone 40. Strap 36 abuts directly against and follows the contour of each of the four corner portions of envelope 22, such as the end edge sections **22*a*, 22*c*, 22*d* thereof that register with each other in FIG. 1. Strap 38 is applied against the exterior face of strap 36. The lower end of exterior strap 38 extends short of the lower end of interior strap 36, but their top ends come in substantial register. A first pair of hook and loop fastener bands 42, 44, such as the VELCRO (a registered trademark) product, releasably interconnect said lower end of exterior strap 38 to the edge section of plastic liner 28*a*: upper band 42 is anchored (e.g., by stitching) to the exterior (bottom) face of strap 38, while lower band 44 is anchored (e.g. by stitching) to the top face of the liner 28*a*. A second pair of hook and loop fastener bands 46, 48 releasably interconnect the top edge section of exterior strap 38, to the edge section of bedsheet 32: upper band 46 is stitched to the underface of the edge section of the bedsheet 32, while lower band 48 is stitched to the exterior (top) face of the top edge section of strap 38. A third pair of hook and loop fastener bands 50, 52 releasably interconnect the mattress cover 30 to the interior strap 36: upper band 50 is stitched to the underface of the edge section of bedsheet 30, while lower band 52 is stitched to the exterior face of the top edge section of interior strap 36**.

In this latter embodiment of securing means, 34, the bedsheet 32 and mattress cover 30 may be of relatively small overall dimensions, in that they need not extend beyond the edges of the top wall **22*d* of waterbed envelope 22**, contrarily to the usual sheets which extend therebeyond on the sides and underface of the waterbed.

Figure 4:
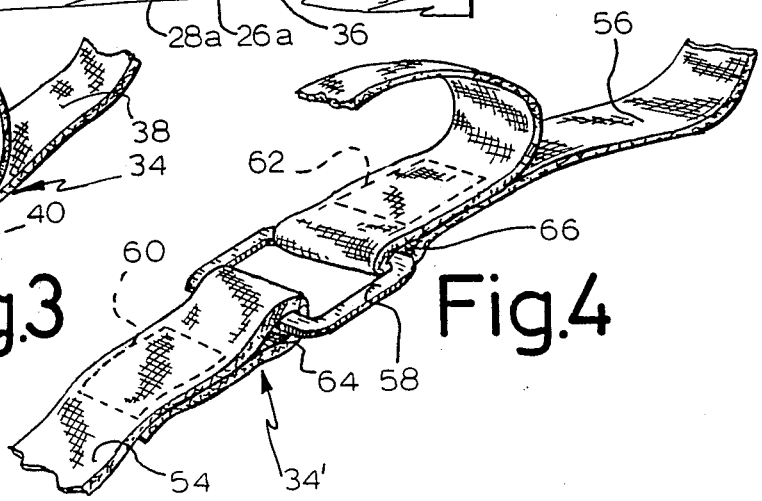
FIG. 4 is an enlarged perspective view of a section of a slightly modified version of the first embodiment of the invention.

FIG. 4 shows a slightly modified version of securing means 34, at 34', in which straps 36, 38 are replaced by two opposite end straps 54, 56 being endwisely interconnected by a square buckle 58: the inner end section of strap 54 and the intermediate section of strap 56 is bent unto itself and sewn at 60, 62, to define ears 64, 66 for passage by two opposite legs of buckle 58. Thus, the two half-sections of the strap 56 corresponds to the upper sections of straps 36–38 of the first embodiment 34; and similarly, the main section of strap 54 corresponds to the bottom section of strap 38 and the short bent section of same strap 54, to the shorter bottom section of strap 36.

Figure 6:
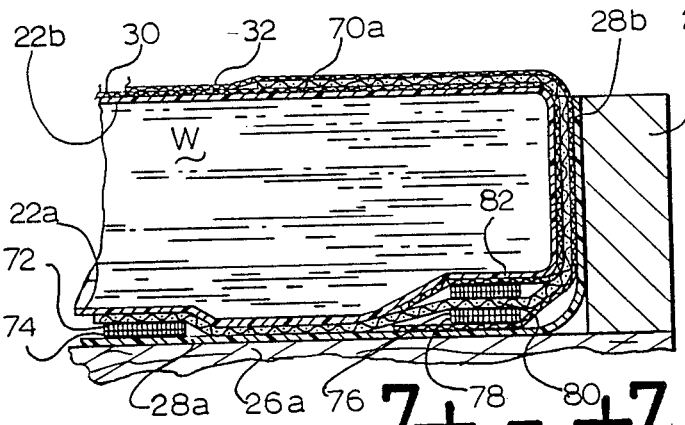
FIG. 6 is a view similar to that of FIG. 2 but at a smaller scale and for said second embodiment of strap means.
Figure 5:
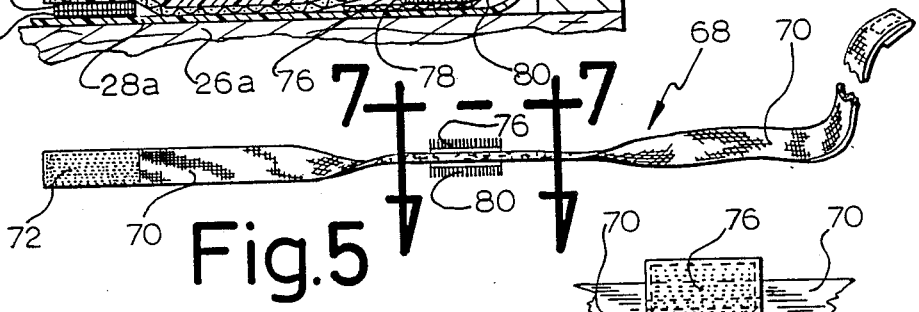
FIG. 5 is a partly broken, perspective view of a second embodiment of said strap means.
Figure 7:
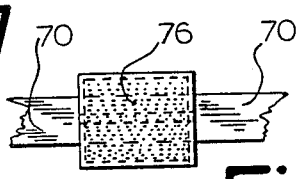
FIG. 7 is a plan view of the sheet fastener about lines 7—7 of FIG. 5.

FIGS. 5–7 show a second embodiment of securing means, at 68. Securing means 68 includes a single elongated strap 70, preferably made from an elastic (extensible) material. Again, three pairs of hook and loop fastener bands 72–82 are provided but, as clearly illustrated in FIG. 6, these bands are all sandwiched between the bottom of water envelope 22 and the top of wooden base 26*a*, contrarily to the first embodiment in which only one hook and loop fastener 42, 44 was sandwiched therebetween. Bands 76 and 80 are stitched in respective register to opposite faces of the intermediate section of strap 70, while band 72 is stitched to one end of strap 70 against the same face as band 76. Bands 76–82 interconnect bedsheet 32 and mattress cover 30 through strap 70: lower band 7i is stitched to the interior (top) face of the lower end section of bedsheet 32, to cooperate with upper strap band 76; upper band 82 is stitched to the (exterior) underface of the lower end of mattress cover 30, to cooperate with lower strap band 80; band 76–82 being sandwiched between the waterbed bottom wall 22*a* and the wooden base 26*a* at the peripheral edge section thereof. Lower band 74 is stitched to the top face of an intermediate section of liner 28*a*, to cooperate with upper strap band 72.

The top horizontal leg of strap 70, at 70*a*, i.e. that leg extending over the top horizontal wall 22*d* of water bed 22, is used as a handle for facilitating the upwardly pulling of the waterbed corner section, for release of the fasteners 72–82 in view of periodic cleaning of the sheets 30, 32.

Figure 8:
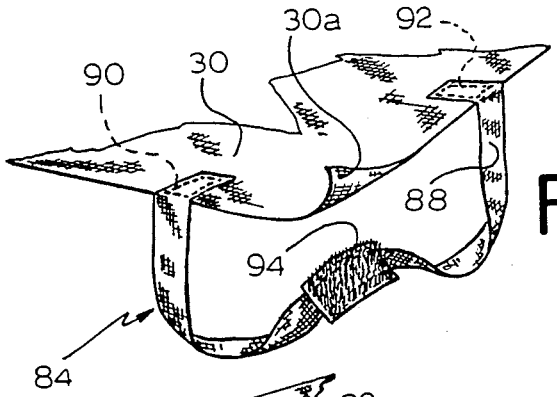
FIG. 8 is a perspective view of the strap means of FIG. 5, showing how it is to be secured to a mattress cover.
Figure 9:
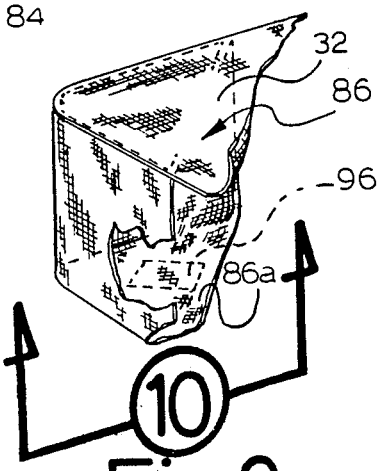
FIGS. 9–10 are perspective views, inverted relative to one another, of a corner flap of bedsheet.
Figure 10:
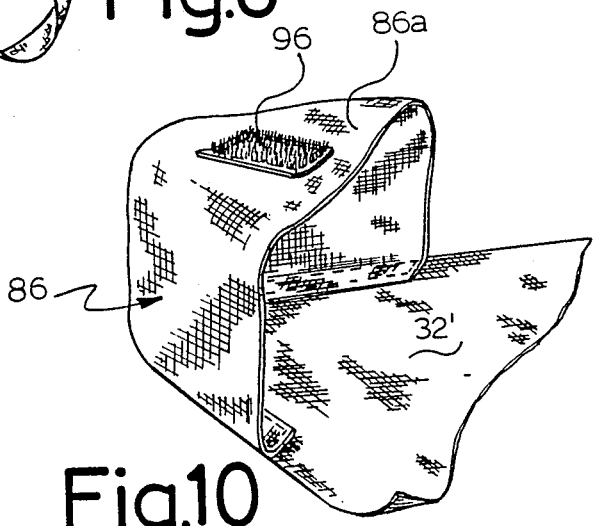

FIGS. 8–10 show a third embodiment of securing means at 84, specifically designed for special bedsheets 32' having known corner flaps or pockets 86 at each corner thereof. These flaps 86 are destined to releasably engage corresponding corners of the waterbed 22. Securing means 84 includes a single strap 88, connected at each end thereof by a hook and loop fastener assembly 90, 92 to the top face of the edge portion of mattress cover 30, at a distance from the tip of the two corner edges 30a. A third hook and loop fastener assembly is constituted by a first band 94, stitched to the intermediate section of strap 88 on the face thereof opposite that of fasteners 90, 92, and a second band 96, stitched to the exterior face of the wall section of flap 86 which is spacedly parallel to the bedsheet proper 32' at 86*a*. (Flap wall 86*a* is the section extending under the waterbed when in operative position)

The hook and loop fastener bands are preferably rectangular, with each pair of co-acting bands being preferably of same dimensions. The width of the fastener bands may be the same as that of the strap proper (see FIG. 1), but it is also envisioned that the hook and loop bands be wider than the strap (such as in FIG. 8).

It is to be understood that other embodiments of sheet securing means not described hereinabove, which operate under the same general principle, could also be used. For instance, the four strap means, one at each corner of the waterbed, could be replaced by only two strap means, with each pair of opposite corner strap means being interconnected by an integral strap extending under the waterbed, so as to form an X. These two crossing straps should be extensible (e.g. made from a wear resistant, sturdy elastomer) or be provided with buckles, to enable variable tensioning thereof, to be adaptable to beds of various dimensions.

The straps are preferably made from a woven nylon or rigid fabric material, although an elastic i.e. extensible sturdy material could also be used. Moreover, it should be understood that the hereinabove fasteners, although referred to as being of the "hook and loop" type, could be of other functionallyequivalent construction: e.g., the similar "mushroom and velours" fastening systems manufactured under the name TWINNEX (a registered trademark), or even plastic leash-type fasteners.

Also, even if the present invention is directed more specifically to waterbeds, it should be noted that these sheet securing means are certainly adaptable to conventional spring mattress beds, or to a portable sleeping bag installed into a closed-floor tent, or to secure the blankets of a baby's crib to the crib frame (to prevent entanglement of blankets and thus the most undesirable possibility of a baby strangling himself with his blankets), while remaining well within the scope of the invention.

Obviously, whenever we refer to sheet securing means for securing a combination of (lower) bedsheet and mattress cover to a bedframe, it should be understood that it is also applicable to the securing of another combination of upper bedsheet and lower bedsheet to the bed frame.

I claim:

1. A sheet securing assembly for use in releasably maintaining in extended condition over the quadrangular mattress of a bed the quadrangular bedsheet and quadrangular mattress cover of that bed, said mattress being supported by a support frame member, said securing assembly comprising four strap members each mounted to one corresponding corner of said quadrangular bed mattress; wherein each strap member includes an elongated body defining first and second end portions, first fastening means proximate said first end portion of said strap, and positioned under said mattress to releasably anchor said strap body to said support frame member, second fastening means to releasably anchor said strap body to said bedsheet, and third fastening means to releasably anchor said strap body to said mattress cover; said second and third fastening means of a given strap being positioned between the two end portions of this strap such that in use, said second and third fastening means are positioned under said mattress, each said strap member further including release means comprised by said second end portion of said release strap, said second end portion being of sufficient length to extend along the side edge portion of the mattress and onto the top edge portion thereof, whereby upon being grasped and pulled with a sufficient force, said second end portion permits effortless disengagement of said fastening means without having to lift said mattress spacedly above said support frame member.

2. A sheet securing assembly as defined in claim 1, wherein said bed mattress is an elastomeric waterbed envelope, said envelope enclosing water and being installed within a large quadrangular recess of a rigid waterbed supporting frame constituting aid support frame member, whereby said water bag shapingly conforms to said recess.

3. A sheet securing assembly as defined in claim 2, wherein said support frame defines within said recess a bottom wall and four side walls and further including an insulating liner, applied directly against said bottom and side walls of said support frame, said first fastening means being anchored to said insulating liner.

4. A sheet securing assembly as defined in claim 1, wherein said third fastening means is in register with said second fastening means.

5. A sheet securing assembly as defined in claim 1, wherein each strap member elongated body is made of a single rigid strap.

6. A sheet securing assembly as defined in claim 5, wherein said rigid strap is made from an extensible material.

7. A sheet securing assembly as defined in claim 1, wherein each one of said fastening means includes a pair of separate fastening bands chosen from the group comprising hook-and-loop fasteners and mushroom-and-velours fasteners.

* * * * *